US006286674B1

(12) United States Patent
Richard et al.

(10) Patent No.: US 6,286,674 B1
(45) Date of Patent: Sep. 11, 2001

(54) CARRYING BAG WITH BALL CONTAINER

(76) Inventors: Ada Richard, 280 Sextus Rd., Oakland, CA (US) 94603; April Lytle, 4227 Knoll Ave., Oakland, CA (US) 94619

( * ) Notice: Subject to any disclaimer, the term of this patent is extended or adjusted under 35 U.S.C. 154(b) by 0 days.

(21) Appl. No.: 09/502,106

(22) Filed: Feb. 10, 2000

(51) Int. Cl.[7] ..... B65D 85/00

(52) U.S. Cl. ..... 206/315.9; 206/457; 224/919; 383/907

(58) Field of Search ..... 206/315.1, 315.9, 206/579, 457; 224/919; 383/117, 907

(56) References Cited

U.S. PATENT DOCUMENTS

| | | | | |
|---|---|---|---|---|
| D. 363,817 | | 11/1995 | Beckwith . | |
| 5,085,320 | | 2/1992 | Scott . | |
| 5,370,287 | | 12/1994 | Cormier . | |
| 5,819,998 | * | 10/1998 | Chehebar | 206/315.1 |
| 5,909,833 | * | 6/1999 | Smith | 224/919 |
| 5,927,581 | | 7/1999 | Reddy et al. . | |

* cited by examiner

*Primary Examiner*—Jim Foster
(74) *Attorney, Agent, or Firm*—Jack Lo

(57) ABSTRACT

The present carrying bag is comprised of a primary container with a primary opening which is closed with a primary zipper for receiving personal items, such as books. Primary straps are attached to the front of the primary container. A ball container is detachably connected to the back of the primary container with a connecting zipper along the periphery of the ball container and on the back of the primary container. The ball container is comprised of a basketball basket for clearly indicating that it is a place to put in a basketball. The ball container is maintained in its shape by a first rib in a rim of the basket, and second ribs in a conical panel of the basket. A lid attached to the top of the ball container is detachably connected to the rim of the basket by a rim zipper. Divided compartments are thus provided for the ball and personal items to provide enough room for them and to prevent them from mixing. The ball container may be detached from the primary container by unzipping the connecting zipper. A ball container strap is attached to the ball container for enabling it to be carried alone.

9 Claims, 2 Drawing Sheets

CARRYING BAG WITH BALL CONTAINER

BACKGROUND OF THE INVENTION

1. Field of the Invention

This invention relates generally to bags and backpacks.

2. Prior Art

Backpacks are typically used by kids for carrying books and supplies to school. Kids who play ball, such as basketball, frequently also carry balls with them to school. However, many types of balls are too big to fit into a conventional backpack already filled with books.

Various specialized backpacks are known in the prior art. An example disclosed in U.S. Pat. No. 5,927,581 to Reddy et al. includes a single compartment for carrying a ball. A mesh window is provided on the backpack for viewing the ball. However, there is no compartment for carrying anything else, such as books. A knapsack disclosed in U.S. Pat. No. 5,819,98 to Chehehar includes a zippered compartment for carrying personal items, and a hinged platform that functions as a miniature basketball court when unfolded. A tiny basketball basket is unfolded from a rear panel of the backpack when the platform is unfolded. Neither the zippered compartment nor the hinged platform can hold a full sized basketball.

A backpack disclosed in U.S. Pat. No. 5,370,287 to Cormier includes front and back halves that are zippered together. The front half includes a compartment for carrying personal items. The back half includes an exterior projection in the shape of half a basketball. The interior of the basketball-shaped projection is hollow for being put on a person's head, so that the back half functions as a cap. Both halves are rigid enough to maintain a preformed shape. However, even if the hollow part of the projection is sized for carrying a basketball, the rear half must be completely detached from the front half to put in or remove the ball, which is very inconvenient. Also, when the back half is detached, the ball would fall out immediately because there is nothing to retain the ball in the hollow space.

A bag disclosed in U.S. Pat. No. 5,085,320 to Scott is comprised of two hemispherical halves that are zippered together to form a spherical bag for carrying a basketball. There is no compartment for carrying anything else. Another sports bag disclosed in U.S. Pat. No. Des. 363,817 to Beckwith includes two hemispherical halves connected by a tubular middle portion. The middle portion is collapsible into the hemispherical halves.

None of the prior art backpacks are sized for carrying a ball and personal items at the same time. Even if they are, each of them only provides a single compartment in which the large ball is mixed with the personal items. Although some of them are ball shaped, none of them literally suggests that it is for carrying a ball.

OBJECTIVES OF THE INVENTION

Accordingly, the objectives of the present carrying bag are:

- to provide a primary container for carrying personal items, such as books;
- to provide a ball container for carry a ball, such as a basketball, football, volleyball, or soccer;
- to provide separate compartments for the ball and personal items to prevent them from interfering with each other;
- to clearly indicate that the ball container is for holding a ball;

- to maintain the shape of the ball container even when it is empty;
- to make putting in the ball very easy; and
- to enable the ball container to be detached from the primary container for being carried separately.

Further objectives of the present invention will become apparent from a consideration of the drawings and ensuing description.

BRIEF SUMMARY OF THE INVENTION

The present carrying bag is comprised of a primary container with a primary opening which is closed with a primary zipper for receiving personal items, such as books. Primary straps are attached to the front of the primary container. A ball container is detachably connected to the back of the primary container with a connecting zipper along the periphery of the ball container and on the back of the primary container. The ball container is comprised of a basketball basket for clearly indicating that it is a place to put in a basketball. The ball container is maintained in its shape by a first rib in a rim of the basket, and second ribs in a conical panel of the basket. A lid attached to the top of the ball container is detachably connected to the rim of the basket by a rim zipper. Divided compartments are thus provided for the ball and personal items to provide enough room for them and to prevent them from mixing. The ball container may be detached from the primary container by unzipping the connecting zipper. A ball container strap is attached to the ball container for enabling it to be carried alone.

Figure 1:
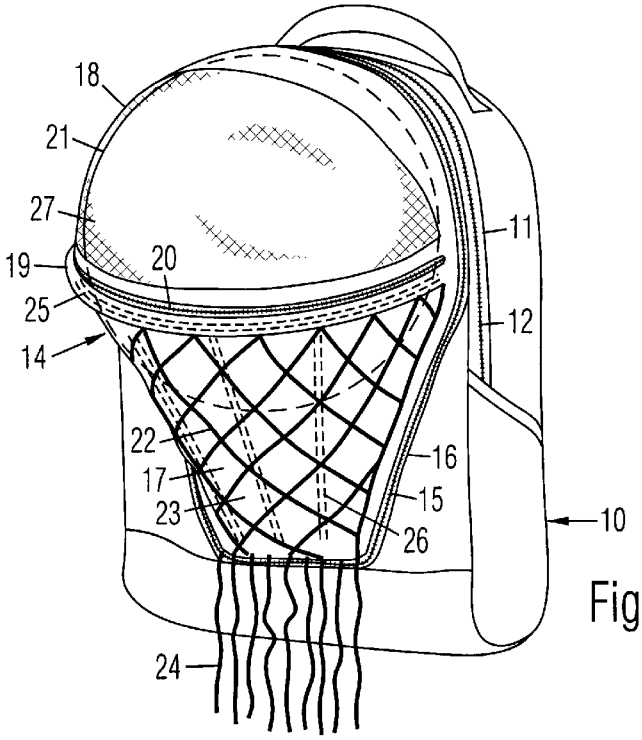
FIG. 1 is a rear perspective view of the present carrying bag with ball container.

| DRAWING REFERENCE NUMERALS |
|---|
| 10. Primary Container |
| 11. Primary Opening |
| 12. Primary Zipper |
| 13. Primary Straps |
| 14. Ball Container |
| 15. Detachable Fastener |
| 16. Base Panel |
| 17. Basketball Basket |
| 18. Lid |
| 19. Rim |
| 20. Rim Zipper |
| 21. Basketball |
| 22. Net |
| 23. Conical Panel |
| 24. Tassels |
| 25. First Rib |
| 26. Second Ribs |
| 27. Mesh Window |
| 28. Ball Container Strap |

DETAILED DESCRIPTION OF THE INVENTION

Figure 2:
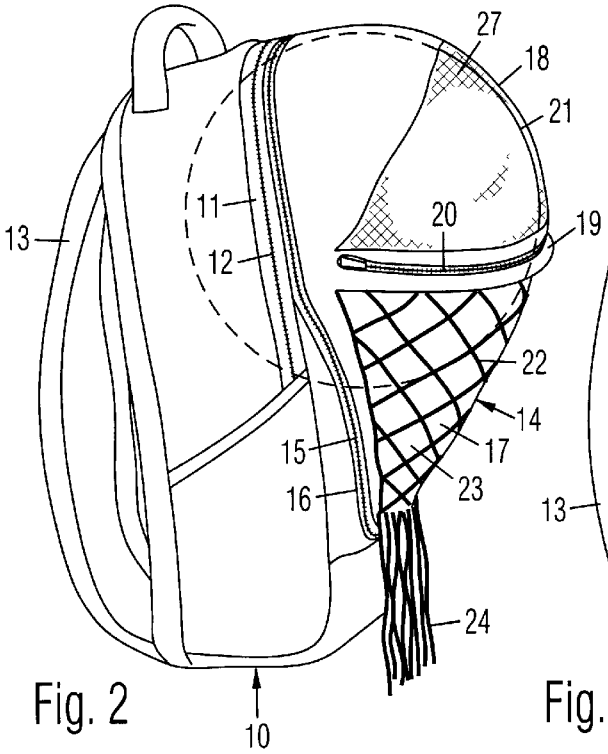
FIG. 2 is a side perspective view thereof

FIGS. 1–2:

A preferred embodiment of the present carrying bag is shown in a rear perspective view in FIG. 1 and a side perspective view in FIG. 2. It is comprised of a primary container 10 with a primary opening 11 which is closed with a primary zipper 12 for receiving personal items, such as books. Primary opening 11 may be of any shape, and may be provided at any convenient location on primary container 10. Primary straps 13 are attached to a front of primary container 10, which is preferably arranged as a backpack. Alternatively, a single primary strap 13 may be provided for being carried on a shoulder. The front of primary container 10 faces the same direction as the front of a wearer, and the back of primary container 10 faces the same direction as the back of the wearer.

A ball container 14 is preferably detachably connected to a back of primary container 10 with a detachable fastener 15, which is preferably a zipper along a periphery of ball container 14 and on the back of primary container 10. Further, the zipper is preferably a hidden zipper. Alternatively, detachable fastener 15 may be of another type of detachable fastener, such as hook-and-loop fasteners, snaps, etc. Also, ball container 14 may be fixedly attached to primary container 10. Divided compartments are thus provided for the ball and personal items to provide enough room for them and to prevent them from mixing.

Ball container 14 is comprised of a base panel 16, a basketball basket 17, and a lid 18 attached to the top of base panel 16 and detachably connected to a rim 19 of basket 17 by a rim zipper 20. Basketball basket 17 clearly indicates that it is a place to put a basketball 21. Alternatively, ball container 14 may be used for carrying other balls or items. Basket 17 preferably includes a net 22 arranged on a conical panel 23. Tassels 24 are attached to the bottom of net 22. Ball container 14 is maintained in its shape, even when empty, by a first rib 25 in rim 19 of basket 17, and a plurality of second ribs 26 in conical panel 23 of basket 17. Second ribs 26 preferably extend between a lower end and an upper end of conical panel 23, but they may be horizontal. Rim 19 of basket 17 is kept rigid in a semi-circular shape by first rib 25 for making inserting ball 21 easier. Lid 18 preferably includes a mesh window 27 which allows the viewing of ball 21.

Figure 3:
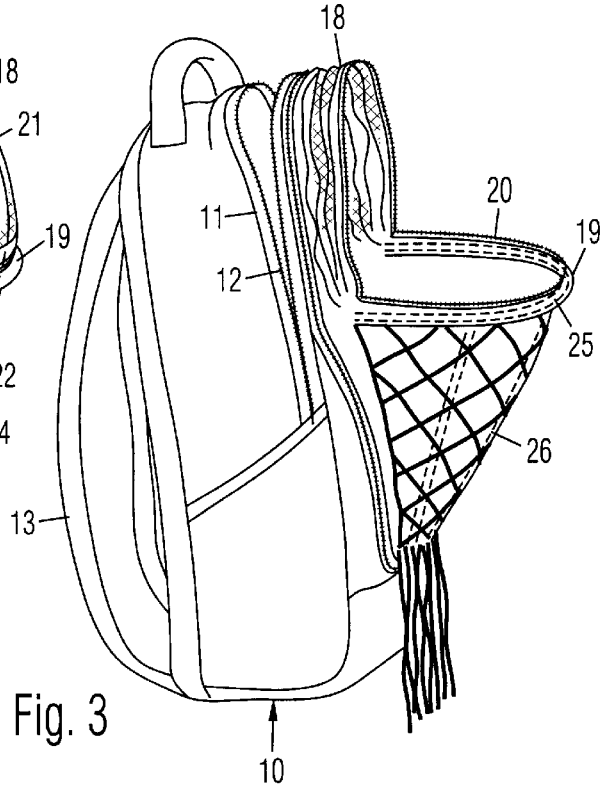
FIG. 3 is a side perspective view thereof with a primary opening of a primary container opened, and a lid of a ball container opened.
Figure 4:
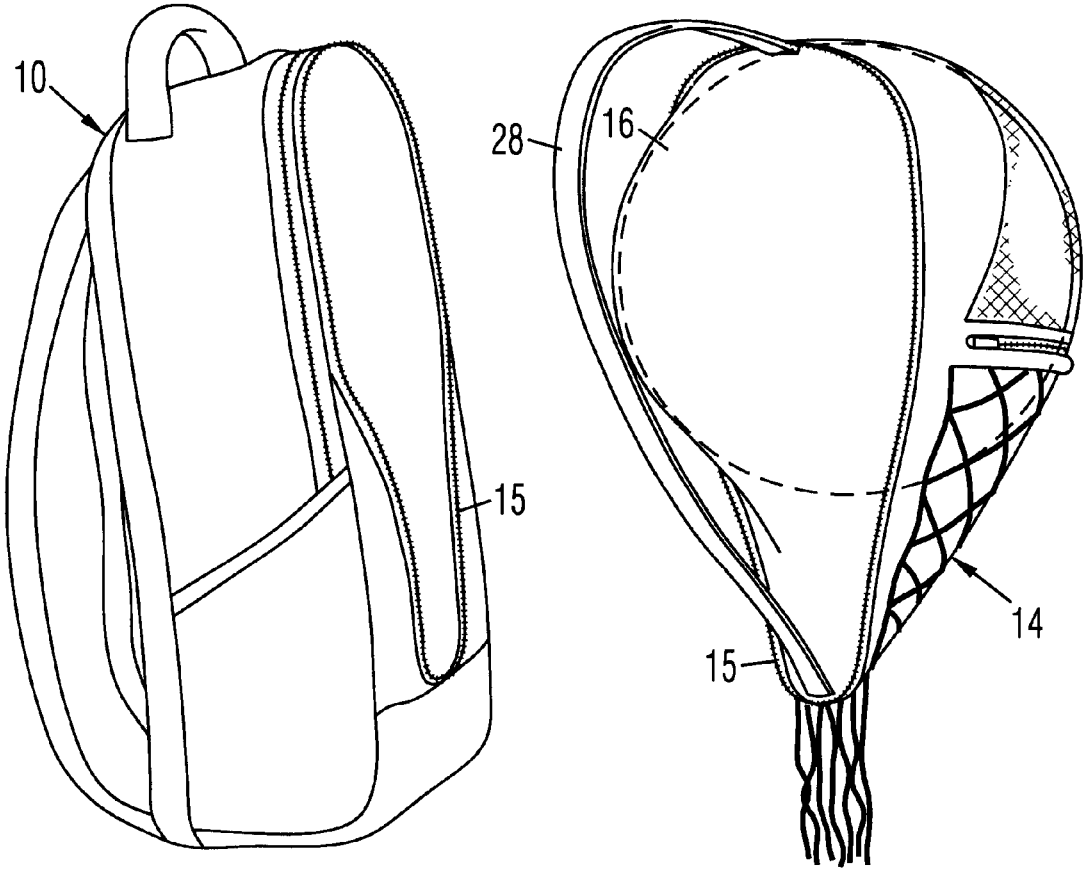
FIG. 4 is a side perspective view thereof with the ball container separated from the primary container.

FIG. 3:

As shown in FIG. 3, primary container 10 and ball container 14 are separately accessible by respectively opening primary opening 11 and lid 18.

FIG. 4:

Ball container 14 may be detached from primary container 10 by disconnecting detachable fastener 15, which in this example is a zipper. A ball container strap 28 is attached to ball container 14 for enabling it to be carried alone without primary container 10. Strap 28 is preferably attached to the front of ball container 14, so that it is tucked between ball container 14 and primary container 10 when they are attached together.

SUMMARY AND SCOPE

Accordingly, the present carrying bag provides a primary container for carrying personal items, such as books. It provides a ball container for carrying a ball, such as a basketball, football, or soccer. It provides separate compartments for the ball and personal items to prevent them from interfering with each other. It clearly indicates that the ball container is for putting in a ball. It maintains the shape of the ball container even when it is empty. It makes putting in the ball very easy. It enables the ball container to be detached from the primary container for being carried separately.

Further, the carrying bag allows a disabled person who enjoys sports to carry a ball for a prolonged period. It allows a person to carry a ball and safely control a bicycle or motorcycle with both hands. It prevents a person from dropping a ball which might roll onto a road where it is dangerous to retrieve.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

We claim:

1. A carrying bag, comprising:

a primary container with a primary opening for receiving personal items; and a ball container attached to a generally flat side of said primary container for receiving a ball, respective divided compartments are thus provided in said ball container and said primary container for said ball and said personal items; wherein said ball container is shaped as a basketball basket to clearly indicate that said ball container is for receiving said ball, said ball container comprising:

a generally conical panel curved in a semi-circle about a vertical axis and attached to said primary container continuously along tapered side edges and a horizontal bottom edge of said conical panel; and a lid positioned over said conical panel with an edge connected to said primary container, and another edge detachably connected to a horizontal top edge of said conical panel to define a fully enclosed compartment when said lid is closed.

2. The carrying bag of claim 1, furthering including a net arranged on said conical panel, a first rib in a rim of said basketball basket, and a second rib generally extending between a lower end and an upper end of said conical panel, said first rib keeping said rim of said basketball basket rigid in a semi-circular shape for making inserting said ball easier, a shape of said basketball basket is thus maintained even when empty.

3. A carrying bag, comprising:

a primary container with a primary opening for receiving personal items;

a pair of primary straps attached to a front of said primary container and enabling said carrying bag to be carried as a backpack;

a ball container detachably connected to a back of said primary container with a detachable fastener, said ball container for receiving a ball, respective divided compartments are thus provided in said ball container and said primary container for said ball and said personal items; wherein said ball container is shaped as a basketball basket to clearly indicate that said ball container is for receiving said ball; and a ball container strap attached to said ball container and enabling said ball container to be carried alone without said primary container.

4. The carrying bag of claim 3, wherein said basketball basket comprises a conical panel, a net arranged on said conical panel, a first rib in a rim of said basketball basket, and a second rib generally extending between a lower end and an upper end of said conical panel, said first rib keeping said rim of said basketball basket rigid in a semi-circular shape for making inserting said ball easier, a shape of said basketball basket is thus maintained even when empty.

5. The carrying bag of claim 3, wherein said detachable fastener comprises a zipper along a periphery of said ball container and on said back of said primary container.

6. The carrying bag of claim 3, wherein said ball container strap is attached to a front of said ball container and tucked between said ball container and said primary container when said ball container is attached to said primary container.

7. A carrying bag, comprising:

a primary container with a primary opening for receiving personal items;

a pair of primary straps attached to a front of said primary container and enabling said carrying bag to be carried as a backpack;

a ball container for receiving a ball, said ball container detachably connected to a back of said primary container with a detachable fastener, respective divided compartments are thus provided in said ball container and said primary container for said ball and said personal items, said ball container comprising:

a vertical base panel detachably positioned against said back of said primary container;

a basketball basket attached to a back of said base panel, said basketball basket comprising a conical panel, a net arranged on said conical panel, a first rib in a rim of said basketball basket, and a second rib generally extending between a lower end and an upper end of said conical panel, said first rib keeping said rim of said basketball basket rigid in a semi-circular shape for making inserting said ball easier, a shape of said basket being maintained, even when empty, by said first rib and said second rib, said basketball basket is thus shaped to clearly indicate that said ball container is for receiving said ball; and a lid with one edge attached to a top of said base panel and another edge detachably connected to said rim of said basketball basket by a rim zipper, said lid including a mesh window for allowing viewing of said ball; and a ball container strap attached to said ball container; thereby said primary container and said ball container are respectively and separately accessible through said primary opening and said lid;

said ball container is detachable from said primary container by disconnecting said detachable fastener, said ball container strap enabling said ball container to be carried alone without said primary container.

8. The carrying bag of claim 7, wherein said detachable fastener comprises a zipper along a periphery of said ball container and on said back of said primary container.

9. The carrying bag of claim 7, wherein said ball container strap is attached to a front of said ball container and tucked between said ball container and said primary container when said ball container is attached to said primary container.

* * * * *